US006698534B2

(12) United States Patent
Miszewski

(10) Patent No.: US 6,698,534 B2
(45) Date of Patent: Mar. 2, 2004

(54) DIRECTION CONTROL IN WELL DRILLING

(75) Inventor: Antoni Miszewski, Budleigh Salterton (GB)

(73) Assignee: Antech Limited, Exeter (GB)

( * ) Notice: Subject to any disclaimer, the term of this patent is extended or adjusted under 35 U.S.C. 154(b) by 0 days.

(21) Appl. No.: 10/150,688

(22) Filed: May 17, 2002

(65) Prior Publication Data

US 2003/0000743 A1 Jan. 2, 2003

(30) Foreign Application Priority Data

Jul. 2, 2001 (GB) ..... 0116159

(51) Int. Cl.[7] ..... E21B 7/04
(52) U.S. Cl. ..... 175/40; 175/45; 175/61
(58) Field of Search ..... 175/92, 45, 61, 175/40; 166/250, 255, 66.5

(56) References Cited

U.S. PATENT DOCUMENTS 5,133,418 A 7/1992 Gibson
5,220,963 A * 6/1993 Patton ..... 175/24
5,311,952 A * 5/1994 Eddison et al. ..... 175/61
5,343,152 A * 8/1994 Kuckes ..... 324/346
5,667,023 A 9/1997 Harrell
6,047,784 A 4/2000 Dorel
6,192,748 B1 * 2/2001 Miller ..... 73/152.01
6,487,782 B1 * 12/2002 Bond ..... 33/302

FOREIGN PATENT DOCUMENTS

WO 98/17894 4/1998

* cited by examiner

*Primary Examiner*—Frank Tsay
(74) *Attorney, Agent, or Firm*—Herbert Dubno

(57) ABSTRACT

A bottom hole assembly for drilling a well, comprising a non-magnetic tubing, an orienter, a motor, a bit fed with drilling fluid which passes through the non-magnetic tubing, and a sensor package contained within the non-magnetic tubing, characterized by a drilling fluid flow tube passing through the non-magnetic tubing adjacent to the sensor package, and means for determining the relative position measurement between the non-magnetic tubing and the motor.

2 Claims, 2 Drawing Sheets

Fig. 1A
PRIOR ART
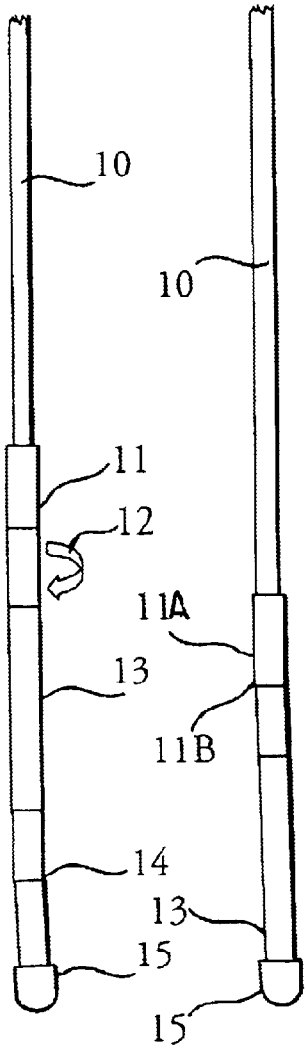
Fig. 1B
PRIOR ART
Fig. 2A
PRIOR ART
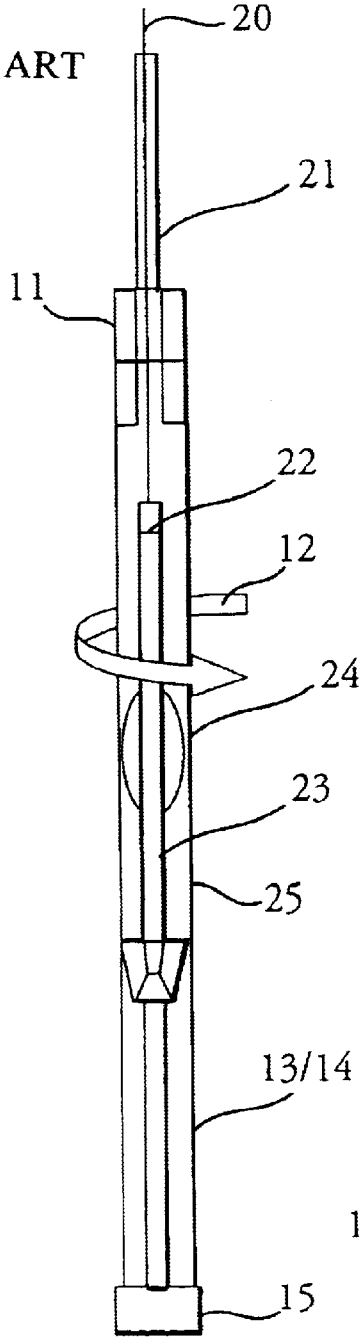
Fig. 2B
PRIOR ART
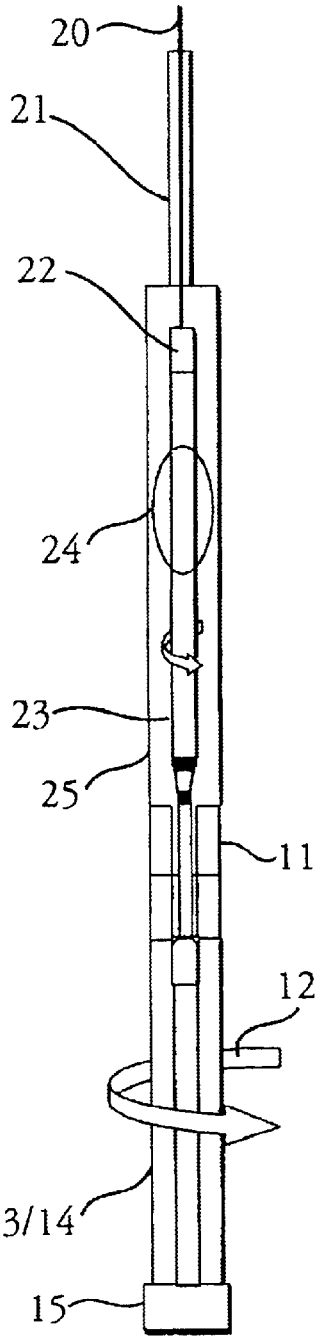

DIRECTION CONTROL IN WELL DRILLING

FIELD OF THE INVENTION

The present invention relates to direction control in well drilling and, more specifically to bottom hole assemblies for performing such drilling.

BACKGROUND OF THE INVENTION

In the drilling industry there is a need to be able to directionally drill a well so that the well trajectory follows a desired path. This may be necessary in order to avoid another obstacle such as another well or in order to accurately aim for a reservoir to be exploited. One of the existing methods of doing this is to use a bottom hole assembly including an orienting device to steer the drill bit in the desired direction. One particular application for this equipment is in short radius gas wells which are drilled in an underbalanced condition (i.e. well flowing). This technique can significantly improve well productivity, and therefore well economics.

This type of well and operation has various specific characteristics. One is build-up rates of over 50°/100 ft (a radius of curvature below 30 to 35 m). This causes high bending forces on the tool; the tools need to physically bend around the curve, because the geometry does not allow straight tools to pass. There is therefore a need for short, slim assemblies to help with rig-up and to negotiate the bend. There is also undamped vibration coming from the drill bit and motor, which adversely affects tool life and reliability. The techniques and requirements of this type of application are already known but all existing equipment suffers from reliability and usability problems, resulting from the way in which the tools are designed.

OBJECT OF THE INVENTION

The general object of the present invention is to provide an improved bottom hole assembly.

SUMMARY OF THE INVENTION

According to the invention there is provided a bottom hole assembly for drilling a well, comprising a non-magnetic tubing, an orienter, a motor and bit fed with drilling fluid which passes through the non-magnetic tubing, and a sensor package contained within the non-magnetic tubing. The assembly has a drilling fluid flow tube passing through the non-magnetic tubing adjacent to the sensor package, and means for determining the relative position measurement between the non-magnetic tubing and the motor. The relative position measurement is the difference between the toolface values (orientations) of the non-magnetic tubing and the motor.

The orienter is preferably of annular form, with the flow tube passing axially through it to the motor.

The present device is suitable for use with coiled tubing and has specific advantages, in terms of reliability and operation, which make it particularly suited to harsh environments

BRIEF DESCRIPTION OF THE DRAWINGS

A bottom hole assembly embodying the invention will now be described, by way of example, without limitation to the scope of the invention, and with reference to the drawings, in which:

FIGS. 1A and 1B show known steerable drill strings including pointing orienters;

FIGS. 2A and 2B show bottom hole assemblies for the drill strings of FIGS. 1A and 1B;

DESCRIPTION OF THE PREFERRED EMBODIMENT

Figure 3:
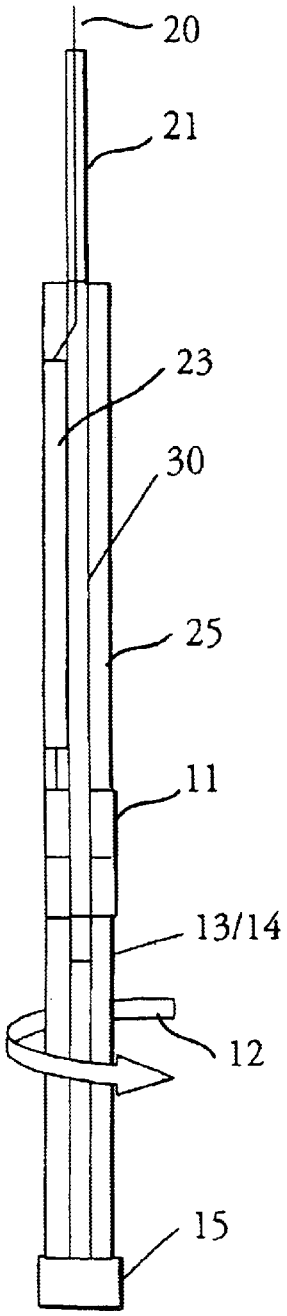
FIG. 3 shows the present bottom hole assembly.

FIG. 1A shows a drill string comprising a drill pipe 10, an orienter 11, a mud motor 13, a bent sub 14, and a drill bit 15. The orienter 11 introduces a bend or deviation into the axis of the drill string, so that viewed vertically from above, the top part of the drill string is seen end on as a circle and then the lower end (mud motor, bent sub, and drill bit) projects away from that circle. The arrow 12 indicates that the bearing of the lower part of the drill string, as seen in such a vertical view, can be adjusted by the orienter. We will use the term "turning" for this bearing adjustment (which must not be confused with the normal rotation of the motor and drill bit for drilling). Some orienters can be stepped on to turn indefinitely; others can turn only over a finite range (e.g. 420°).

FIG. 1B shows a variant of the drill string of FIG. 1A, in which there is a pointing orienter 11A with torque resistant joint 11B, and the bent sub is omitted.

FIG. 2A shows a typical bottom hole assembly of the FIG. 1 type in more detail. The assembly is suspended from coiled tubing 21 through which a cable 20 passes. The coiled tubing is attached to an orienter 11 located at the top of a non-magnetic tubing 25. The cable 20 passes through the orienter to a swivel 22 which coupled it to a steering tool 23. A centralizer 24 locates the steering tool centrally in the non-magnetic tubing 25. A motor 13 and bent sub 14 are attached to the lower end of the non-magnetic tubing 25, and the drill bit 15 is mounted on the end of the motor.

The steering tool 23 is a sensor package which comprises various sensors such as accelerometers, magnetic sensors which sense the direction of the earth's magnetic field, etc., so that the position and orientation of the bottom hole assembly is known. The non-magnetic tubing 25 is a casing, flexible enough to permit the bottom hole assembly to be physically bent when a well with a tight curve is being drilled, and is non-magnetic so that the earth's magnetic field can reach the steering tool. The bent sub introduces a small bend (of up to say 3°), which makes it easier to get a bend in the well hole started. The fluid for the motor flows through the non-magnetic tubing 25 around the steering tool 23.

FIG. 2B shows a variant on this design, where the orienter is in a different position on the bottom hole assembly.

In order to directionally guide the drill string, the motor and bit need to be turned (as discussed above), i.e. to have the direction or bearing of the lower part of the bottom hole assembly adjusted to a desired value. This is effected by the orienter, which turns the motor (i.e. adjusts its bearing) in relation to the coiled tubing above. The steering tool is connected mechanically to the motor below and to the electric cable above. The swivel between the cable and the steering tool prevents the cable from becoming twisted. The fluid used to drive the drilling motor passes through the coiled tubing, through the orienter, through the annular space around the steering tool, and then to the motor. The centralizer around the steering tool keeps the steering tool centered in the non-magnetic tubing and prevents it from waving around. (There may be more than one centralizer.)

Both of these designs suffer from the same problems. In harsh environments, such as those experienced when nitrogen gas is the drilling fluid, there are very high vibrational forces. These are caused by the poor damping characteristics of gas and the high fluid flow rates. Under these conditions two things happen: the steering tool tends to flap around even when centralized with the spring centralizers, and the fluid flow creates vortices which can cause erosion locally in the flow path. All joints that have any free play tend to fail because of the environment which can cause serious wear.

In the present system, a flow tube for the drilling fluid is passed from the top of the bottom hole assembly to the top of the motor. This tube is of a uniform diameter and can be constructed to have no joints that need to be broken in order to work with the tool. This creates a smooth flow path, so creating less fluid turbulence and therefore less vibration and risk of erosion.

More specifically, referring to FIG. 3, the present bottom hole assembly is suspended from a coiled tube 21 containing a cable 20. A non-magnetic tubing 25 has an orienter 11 at its lower end connected to a motor and bent sub 13/14 with a drill bit 15 at its end. A steering tool 23 is located in the non-magnetic tubing 25, and a flowtube 30 also passes through the non-magnetic tubing 25, alongside the steering tool 23; this flowtube forms an extension of the coiled tube 21 and is coupled to the motor/bent sub 13/14. The flowtube 30 can conveniently be of roughly circular section, and it and the steering tool 23 are held side by side in the non-magnetic tubing 25.

However, this arrangement creates a problem which needs to be overcome. In the known designs, the steering tool is rotationally linked to the motor and bent sub such that when the orientation of the motor and bent sub is changed, the steering tool orientation is also changed. In the present design, the mechanical layout prevents this from happening, so the steering tool does not respond in relation to the motor orientation. The orientation of each part is referred to as the toolface reading.

Figure 4A:
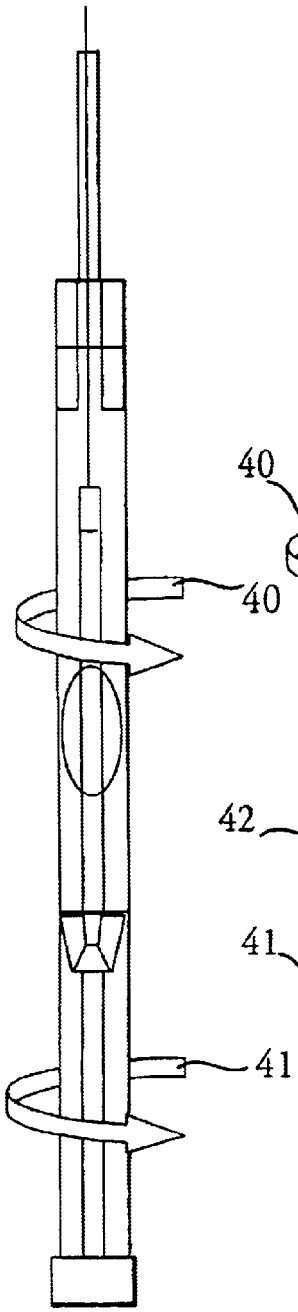
FIGS. 4A and 4B illustrate respectively the geometry of the known and the present systems.

The relationship between the steering tool and the motor toolfaces for the known tools of the FIGS. 2A and 2B type can be shown diagrammatically as in FIG. 4A. Arrow 40 shows how the toolface for the steering tool turns, and arrow 41 shows how the toolface for the motor turns. The steering tool is mechanically coupled to the motor, so these two toolfaces are the same.

Figure 4B:
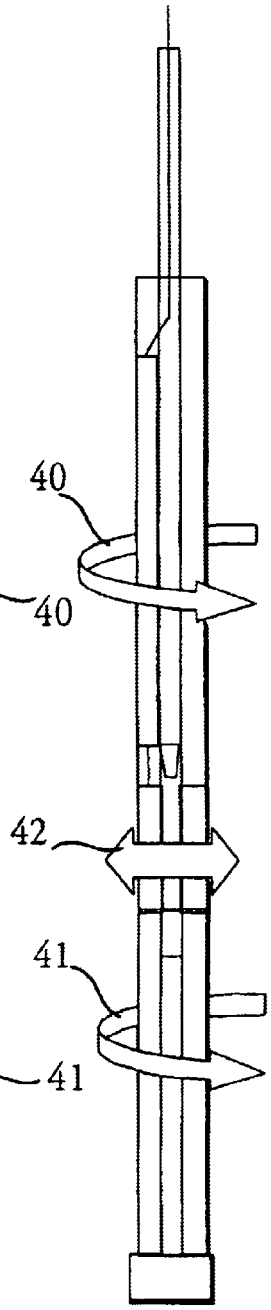

FIG. 4B shows the corresponding relationship for the present arrangement. Arrow 40 shows how the toolface the steering tool turns, and arrow 41 shows how the toolface for the motor turns. In this arrangement, these two toolfaces are not necessarily the same. The difference in rotational position between the steering tool and the motor is called the relative position measurement. The arrow 42 indicates the difference between these two toolfaces. To set the motor toolface (arrow 41) to a desired value, it is necessary to take the value of the steering tool toolface (arrow 40), which is obtainable from the sensors in the steering tube and then to adjust the relative position measurement (arrow 42) accordingly. (FIG. 4B shows the flowtube as lying centrally in the non-magnetic tubing, but in practice the flowtube will generally be displaced to lie opposite the steering tool.)

For this, it is necessary to measure the difference in rotational position between the steering tool and the motor. This value is determined by a sensor inside the orienter. This sensor can be a discrete sensor such as a resolver, or the value can be determined by the signal generated from the sensors (e.g. Hall effect) inside a brushless DC motor such as are typically used in such an application. Depending on the type of sensor used, it may be necessary to have a non-volatile memory to remember the relative position measurement in the event of a power loss.

Figure 5:
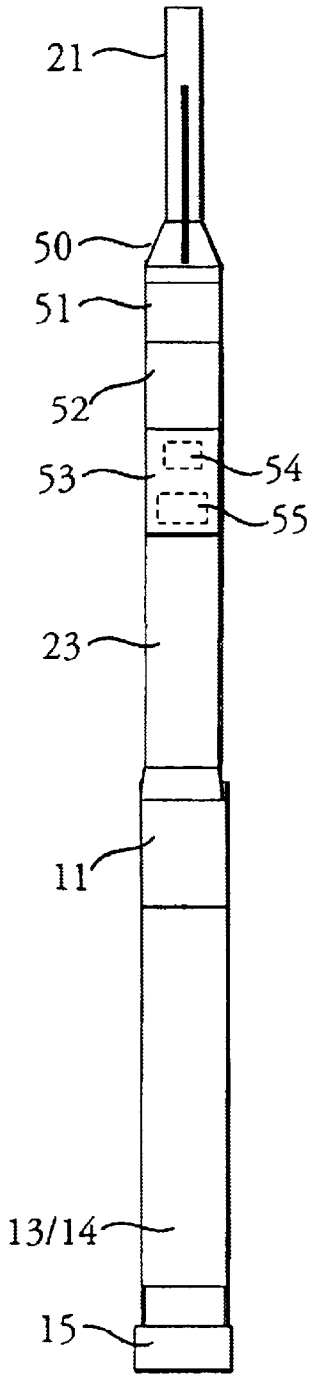
FIG. 5 shows the present assembly in more detail.

FIG. 5 shows the present assembly in more structural detail. The coiled tubing 21 is connected via a tubing end connector 50 and a cable head 51 to an electric release unit 52. Below that, and contained within the non-magnetic tubing, there is a sensor section 53 which contains a telemetry unit 54 and a sensor assembly 55. The sensor assembly can conveniently contain a vibration sensor, a pressure sensor, a weight-on-bit (load) sensor, a natural gamma ray sensor, and so on. The sensor section 53 is generally adjacent to the steering tool 23 and the flowtube.

It will of course be realized that there is considerable freedom in the division of sensors between the steering tool and the sensor assembly. The flowtube may be offset in the non-magnetic tubing, leaving a lune-shaped space around it, or substantially central, as shown in FIG. 4B, leaving an annular space around it. The various sensors of the instrumentation may be located as convenient in this space around the flowtube. The instrumentation can be robustly supported along the length of the non-magnetic tubing.

The orienter 11 of the present apparatus is preferably of annular form, such that the flow tube passes axially through it to the motor 13.

The present technique is equally applicable to rotating and pointing orienters. (In a conventional rotating orienter, the lower part physically rotates relative to the upper part to turn the orientation; in a pointing orienter, the lower part does not physically rotate.) For a pointing orienter, two position readings need to be taken from the orienter mechanism to define the direction in which the motor/bit is pointing (a bent sub is not required). These are then used to create the relative position measurement, which is used with the steering tool toolface reading to define direction of point.

Thus in the present arrangement, a straight through flow path for the drilling fluid is created by the flow tube. The packaging of the instrumentation in the non-magnetic tubing makes it possible to provide anti-vibration mounting, and also contributes to shortening the overall length of the arrangement. Further, the steering tool is mechanically decoupled from the motor movement by using a feedback signal from the orienter; this also means that a pointing orienter can be used.

Alternative embodiments using the principles disclosed will suggest themselves to those skilled in the art upon studying the foregoing description and the drawings. It is intended that such alternatives are included within the scope of the invention, the scope of the invention being limited only by the claims.

What is claimed is:

1. A well-drilling apparatus comprising:

a coiled tubing having a lowerable end; and a bottom hole assembly for drilling a well suspended from said coiled tubing at said lowerable end, said bottom hole assembly comprising:

a length of nonmagnetic tubing, a motor and drilling bit driven by said motor below said length of nonmagnetic tubing, an orienter along said nonmagnetic tubing above said motor for orienting said motor and bit relative to said nonmagnetic tubing, a sensor package within said length of nonmagnetic tubing at an upper portion thereof, a drilling fluid flow tube extending through said length of nonmagnetic tubing from said coiled tubing to said motor and bit and alongside said sensor package, and a device for determining a relative position measurement between said motor and said nonmagnetic tubing.

2. The well-drilling apparatus defined in claim 1 wherein said orienter is of an annular form and said drilling fluid flow tube passes axially through said orienter.

* * * * *